United States Patent [19]

Munari

[11] Patent Number: 5,046,268

[45] Date of Patent: Sep. 10, 1991

[54] SKI BOOT WITH ADJUSTABLE SPOILER

[75] Inventor: Giovanni B. Munari, Montebelluna, Italy

[73] Assignee: Dolomite S.p.A., Montebelluna, Italy

[21] Appl. No.: 446,749

[22] Filed: Dec. 6, 1989

[30] Foreign Application Priority Data

Dec. 6, 1988 [IT] Italy ..... 22881 A/88

[51] Int. Cl.[5] ..... A43B 5/04

[52] U.S. Cl. ..... 36/117; 36/118; 36/119

[58] Field of Search ..... 36/117, 118, 119, 120, 36/121

[56] References Cited

U.S. PATENT DOCUMENTS 3,945,135 3/1976 Hanson et al. ..... 36/118
4,615,127 10/1986 Delery ..... 36/119
4,864,743 9/1989 Begey et al. ..... 36/119
4,907,354 3/1990 Benoit et al. ..... 36/119

FOREIGN PATENT DOCUMENTS 0158574 10/1985 European Pat. Off. ..... 36/117
0316605 5/1989 European Pat. Off. ..... 36/117

*Primary Examiner*—Paul T. Sewell
*Assistant Examiner*—M. Denise Patterson
*Attorney, Agent, or Firm*—Sughrue, Mion, Zinn, Macpeak & Seas

[57] ABSTRACT

On a ski boot provided with a shell defining a quarter and a spoiler mounted to the quarter, there are provided first and second adjusting devices active between the spoiler and the quarter to controllably shift the spoiler along two directions substantially perpendicular to each other.

7 Claims, 2 Drawing Sheets

SKI BOOT WITH ADJUSTABLE SPOILER

DESCRIPTION

This invention relates to a ski boot of a type which comprises a shell defining a quarter, a rear support plate mounted to the quarter, and a means of adjusting the rear support plate position relatively to the quarter.

In ski boots of recent manufacture, the shell is usually formed with an upwardly directed extension in continuation of the quarter, which extension provides support for the skier's calf. This in order to alleviate the skier's fatigue where he/she adopts skiing techniques wherein his/her weight is to be shifted rearwardly (toward the tail ends of the skis) from the normally balanced position.

Such extensions have become known by the term "rear support plates".

Highly sophisticated design boots, such as those intended for use in competitions or for recreational use of a high level, incorporate provisions for adjusting the rear support plates position with respect to the quarter so as to match the boot to the morphology of the skier's leg.

This adjustment may be accomplished, for example, by providing a wedge-shaped rear support plates to be fitted into the shell with its tip toward the sole.

By varying the depth to which the rear support plates is inserted into the shell, the extent of the support provided for the skier's leg can be varied accordingly.

In another conventional adjustment arrangement, the rear support plates is carried on a nut and screw mechanism attached to the quarter, whereby the distance of the rear support plates from the inner wall of the quarter can be adjusted.

In the former case, the rear support plate can be adjusted both in the vertical and horizontal directions; the two adjustment modes are, however, dependent on each other, thereby ski boots so equipped ill-fit skiers having a particular morphology of the leg, such as a slim leg with the calf muscles placed high on the leg, or conversely, plump legs with the calf muscles placed low on the leg.

In the latter case, the rear support plate can only be adjusted in the horizontal direction; this horizontal adjustment is useful to have the boot matched to the more or less slim character of the skier's leg, but takes into no account the specific conformation of the calf muscles.

The problem that underlies this invention is to provide a ski boot which has such structural and functional characteristics as to overcome all the problems with which the cited prior art is beset.

SUMMARY OF THE INVENTION

This problem is solved by a ski boot of the kind specified above being characterized in that said adjusting means comprises first and second adjusting devices active between the rear support plate and the quarter to adjustably shift said rear support plate relatively to the boot shell along two directions lying substantially perpendicular to each other.

Advantageously, the first device comprises a nut and screw mechanism attached to the quarter and carrying a plate onto which said rear support plate bears.

According to a further aspect of the invention, the second device comprises a nut and screw mechanism active between the rear support plate and the plate of the first adjusting device.

BRIEF DESCRIPTION OF THE DRAWINGS

The features and advantages of this invention will become more clearly apparent from the following detailed description of a preferred, though not exclusive, embodiment thereof, given by way of illustration and not of limitation with reference to the accompanying drawings, where.

DETAILED DESCRIPTION OF THE INVENTION

Figure 1:
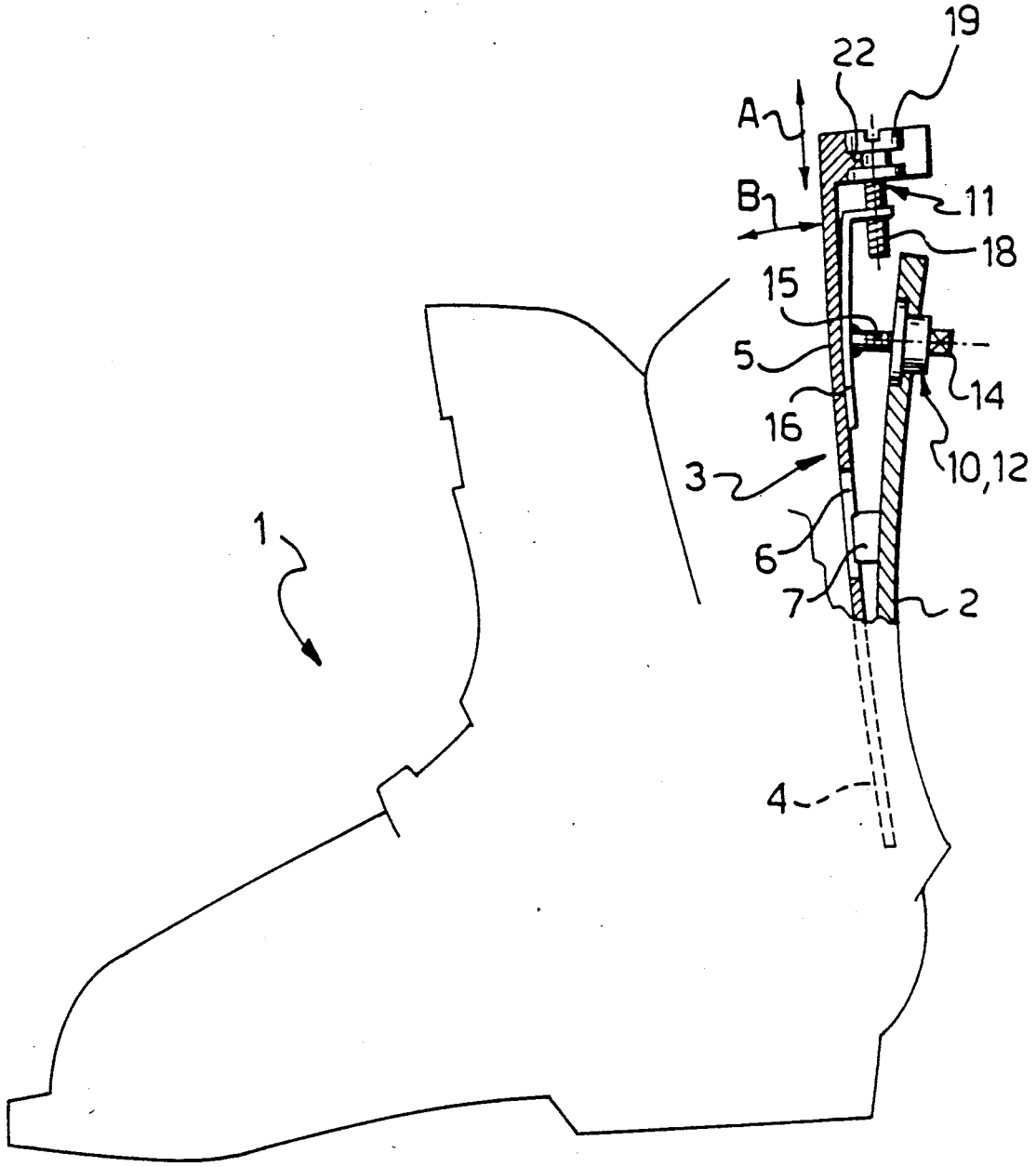
FIG. 1 is a part-sectional longitudinal section view showing schematically a shell for ski boots embodying this invention.
Figure 2:
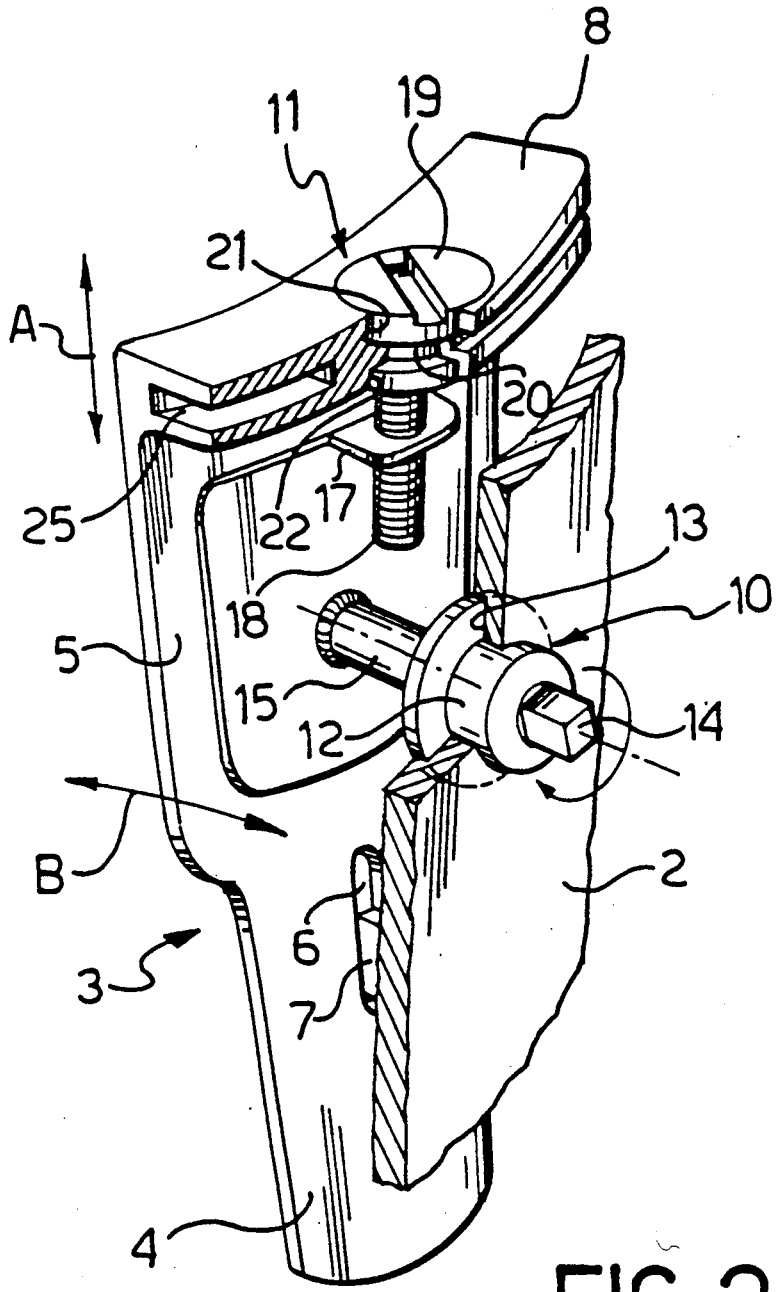
FIG. 2 is a part-sectional perspective detail view of the shell shown in FIG. 1.

In the drawing figures, generally indicated at 1 is a ski boot shell molded from a plastics material.

The shell 1 comprises a quarter 2 having a rear support plate 3 attached thereto. The rear support plate 3 is made of a plastics material and configured as an elongate paddle whereon a tongue portion 4 and an expanded portion 5 are defined, the latter being intended to provide support for a skier's leg.

The portion 4 is formed with a blind slotted hole 6 wherein an elevation 7 of the shell engages slidably to hold the rear support plate 3 guided relatively to the quarter 2.

The portion 5 has, on its free top end, a molding 8 projecting outwards from the shell 1.

In order to vary as desired the position of the rear support plate 3 relatively to the quarter 2, first and second adjusting devices are provided as indicated at 10 and 11, respectively.

The device 10 comprises a nut and screw mechanism 12 of conventional construction which is made unitary with the quarter 2 within a socket 13 formed in the latter. The mechanism 12 is provided with a tang 14 for carrying a knob, not shown, and with a threaded stem 15, located opposite from the tang 14, having a plate 16 attached to its free end.

The structure of the mechanism 12 is such that, by turning the tang 14 in one direction oz the other, the plate 16 can be respectively moved toward or away from the wall of the quarter 2 to which the mechanism 12 is secured.

The plate 16, on which the expanded portion 5 of the rear support plate 3 is normally arranged to bear, has an edge 17 bent to a right angle. Formed in the edge 17 is a threaded hole into which a screw 18 of the second adjusting device 11 is engaged.

The screw 18 has a cylindrical head 19 formed with a circumferential groove 20.

The head 19 of the screw 18 engages rotatably tucked away inside a socket 21 formed in the molding 8 of the rear support plate 3; the socket 21 is substantially cylindrical and not fully closed on itself, thereby the head 19 can be pushed in by elastically deforming the rear support plate.

The socket 21 is formed with a bead 22 adapted to engage in the groove 20 on the screw 18, such that the rear support plate 3 will be held suspended from the plate 16 of the adjusting device 10 by means of the screw 18.

A cap or hood, not shown, may be mounted between the molding 8 of the rear support plate 3, as purposely provided with a groove 25, and the quarter 2 to prevent snow or ice from getting in between the rear support plate 3 and the shell 1.

As may be appreciated, the ski boot of this invention has the rear support plate adjustable along two mutually orthogonal directions: a substantially vertical direction, indicated by an arrow A in FIG. 1, wherealong adjustment is performed by turning the screw 18, and a substantially horizontal direction, indicated by an arrow B in FIG. 1, wherealong adjustment is performed by turning the tang 14 of the mechanism 12.

Thus, the rear support plate can be adjusted in the most appropriate manner to fit both the slimness of a skier's leg and the conformation of his/her calf.

I claim:

1. A ski boot comprising:

a shell including a foot portion and a leg portion, a rear support plate extending at least in part within said leg portion and adjustably projecting outwardly therefrom and means for adjusting the rear support plate position relative to said leg portion, said adjusting means comprising first and second adjusting means operatively connected between said rear support plate and said leg portion for adjustably shifting said rear support plate relative to said leg portion along two directions lying substantially perpendicular to each other, one of said directions being a vertical adjustment of the depth to which the rear support plate is inserted into the shell.

2. A ski boot as set forth in claim 1, wherein said first adjusting means comprises a nut and screw mechanism operatively connected to said leg portion and carrying a plate disposed in contact with said rear support plate to control movement of said rear support plate toward and away from said leg portion.

3. A ski boot as set forth in claim 2, wherein said second adjusting means comprises a nut and screw mechanism operatively connected between said rear support plate and said plate for controlling movement of said rear support plate in a direction parallel to said plate.

4. A ski boot as set forth in claim 3, wherein said rear support plate is suspended from said second adjusting means.

5. A ski boot as set forth in claim 3, wherein said rear support plate is provided with a socket adjacent an upper end thereof in which said nut and screw mechanism of said second adjusting means is engaged.

6. A ski boot as set forth in claim 5, wherein said socket is partially open at one side thereof and said rear support plate is elastically deformable at least adjacent said socket.

7. A ski boot as set forth in claim 5, wherein said socket is formed with a bead engagable in a circumferential groove provided on said screw for rotatably mounting said screw in said socket.

* * * * *